US006206649B1

(12) United States Patent
Yie

(10) Patent No.: US 6,206,649 B1
(45) Date of Patent: Mar. 27, 2001

(54) PROCESS AND APPARATUS FOR PRESSURIZING FLUID AND USING THEM TO PERFORM WORK

(75) Inventor: Gene G. Yie, Auburn, WA (US)

(73) Assignee: Jetec Company, Auburn, WA (US)

( * ) Notice: Subject to any disclaimer, the term of this patent is extended or adjusted under 35 U.S.C. 154(b) by 0 days.

(21) Appl. No.: 09/293,679

(22) Filed: Apr. 16, 1999

Related U.S. Application Data

(63) Continuation-in-part of application No. 09/153,274, filed on Sep. 14, 1998.

(51) Int. Cl.[7] ..... F04B 1/12

(52) U.S. Cl. ..... 417/269; 417/225; 417/222; 137/509

(58) Field of Search ..... 417/269, 222, 417/225, 347; 137/509, 624.13, 624.18; 91/36, 39, 524

(56) References Cited

U.S. PATENT DOCUMENTS

| | | | | |
|---|---|---|---|---|
| 1,763,154 | * | 6/1930 | Holzwarth | 137/624.13 X |
| 2,100,154 | * | 11/1937 | Ashton | 137/624.13 |
| 2,398,542 | * | 4/1946 | Light | 137/624.13 X |
| 2,477,590 | * | 8/1949 | Ferwerda | 137/624.13 X |
| 2,818,881 | * | 1/1958 | Bonner et al. | 137/624.13 X |
| 2,970,571 | * | 2/1961 | Pecchenino | 137/624.13 X |
| 3,348,495 | * | 10/1967 | Orshansky | 91/480 X |
| 4,277,229 | * | 7/1981 | Pacht | 417/539 X |
| 4,534,427 | | 8/1985 | Wang et al. | 175/67 |
| 4,551,077 | * | 11/1985 | Pacht | 417/539 X |
| 4,555,872 | | 12/1985 | Yie | 51/439 |
| 4,611,973 | * | 9/1986 | Birdwell | 417/347 X |
| 4,621,988 | * | 11/1986 | Decker | 417/347 X |
| 4,701,110 | * | 10/1987 | Iijima | 417/269 |
| 4,776,260 | | 10/1988 | Vincze | 92/86 |
| 5,092,362 | | 3/1992 | Yie | 137/596.1 |
| 5,117,872 | | 6/1992 | Yie | 137/882 |
| 5,186,393 | * | 2/1993 | Yie | 239/583 |
| 5,241,986 | | 9/1993 | Yie | 137/512 |
| 5,297,777 | | 3/1994 | Yie | 251/214 |
| 5,524,821 | | 6/1996 | Yie et al. | 239/10 |
| 5,799,688 | | 9/1998 | Yie | 137/505.13 |
| 5,879,137 | | 3/1999 | Yie | 417/225 |
| 5,927,329 | | 7/1999 | Yie | 137/624.13 |

FOREIGN PATENT DOCUMENTS

3413867 * 10/1984 (DE) .

* cited by examiner

*Primary Examiner*—Teresa Walberg
*Assistant Examiner*—Jeffrey C Pwu
(74) *Attorney, Agent, or Firm*—Pauley Petersen Kinne & Fejer

(57) ABSTRACT

A fluid pressurization apparatus utilizing a slanted cam disk to oscillate, or to oscillate and rotate a set of piston assemblies arranged in a circle. The motion of the pistons is utilized to pressurize fluid or to perform work. The piston assemblies have multiple elements configured to allow the plungers to be engaged or disengaged to the motion of a disk by manipulating a working fluid introduced into the apparatus. By virtue of these disengageable plungers, the apparatus can be disabled and resumed at will. This apparatus is particularly well suited for pressurizing liquids such as water for high-pressure and high-flow applications.

27 Claims, 11 Drawing Sheets

PROCESS AND APPARATUS FOR PRESSURIZING FLUID AND USING THEM TO PERFORM WORK

This application is a continuation-in-part of Ser. No. 09/153,274 filed Sep. 14, 1998.

FIELD OF THE INVENTION

This invention is directed to an apparatus for transferring and pressurizing fluids, especially liquids, and a process for using pressurized fluids to perform work.

BACKGROUND OF THE INVENTION

Pumps and intensifiers are devices for introducing energy into a fluid so as to move it from point A to point B or to pressurize it to perform work. The word "pump" generally refers to apparatus that converts shaft power of an engine or motor to kinetic energy in moving fluid or potential energy in pressurized fluids, or both. Intensifiers are devices that transfer stored energy from one pressurized fluid, generally referred to as a working fluid, to another fluid, generally referred to as a system fluid. The two fluids are often different but can be the same.

There are many types of pumps. For instance, pumps are critical to the operation of fluid power systems. The selection of available pumps is very wide when the system pressure is low and the system operation is simple. The selection becomes narrower when the system pressure is very high, and the system operations are more demanding. By way of example, today's waterjetting processes are carried out at very high flow and pressure.

High-pressure waterjetting is now an accepted method for removing deteriorated coatings from various structures, such as storage tanks, bridges, and ship hulls. The system pressure of these processes is commonly 40,000 psi or higher. At these pressures, the fluid induced forces and stresses are very high. Specialized high-pressure pumps are required for handling water at such pressure levels.

Due to the high cost of labor, downtime, and dry dock fees, the cleaning of structures must also be performed at high speed and with good results. Waterjetting must be applied not only at high pressures but also at high flow rates. The flow capacity of these high-pressure pumps must also be very high.

Many waterjetting operations cover a large surface area, such as the hull of today's supertankers. The mobility of the pump system is one concern, because it may have to be moved often. The weight and compactness of the pump are related concerns.

Pumps for today's waterjetting processes must also be versatile and reliable. The high-pressure water flow needs to be turned on and off frequently. This task is simple when the system pressure is very low, but more difficult at very high pressures. Popular crankshaft pumps do not have this capability. The user has to dump the water or to shut off the motor or engine if the high-pressure waterjet is to be temporarily shut off.

The reliability of the pump is also important in today's waterjetting processes. The down time must be kept at a minimum, otherwise the profit of an operation can be lost.

Current waterjetting processes are often carried out with crankshaft pumps, also known as "oil field" pumps. These pumps are large and bulky, and typically have 3 or 5 pistons linked mechanically to a crankshaft. If one piston fails, the entire pump is basically out of order. If the crankshaft develops faults, the pump also fails. These pumps have no mechanism for stoppage. The only way to stop output is to dump the flow or shut off the engine or motor.

At present, crankshaft pumps are limited to a maximum system pressure of 40,000 psi. For operations at pressures above 40,000 psi, double-acting fluid pressure intensifiers are used. These hydraulically powered intensifiers have two opposed plungers sharing a common power piston. The output power of these intensifiers is discontinuous, and dead-volume high-pressure accumulators are required to reduce the pressure pulsations. These intensifiers are also very bulky in respect to their flow capabilities and have a geometry not conducive for many applications. The intensifiers also require electricity to operate, which can be difficult to provide in remote waterjetting operations.

SUMMARY OF THE INVENTION

The invention is directed to an apparatus for transferring and pressurizing fluids, especially liquids, and a process for using pressurized fluid to perform work. The invention includes a pump useful for waterjetting and various other applications. The apparatus is compact, and has the ability to operate at high pressures and flow rates. The apparatus can also be stopped and started frequently, as desired, without substantial effort. In addition to a pump, the apparatus can be used as a fluid powered motor, a fluid distribution device, or another fluid transfer device.

The apparatus of the invention includes a housing having an internal housing cavity, a drive shaft communicating with the internal housing cavity, and a first rotatable cam disk (or first and second rotatable cam disks) having a first end communicating with the drive shaft and a second end having a slanted surface. A plurality of pistons are arranged in the housing cavity. Each piston has a first end communicating with the slanted surface of the first or second rotatable cam disk, and a second end away from the cam disk. The pistons are located in a plurality of piston chambers in the housing cavity. Each piston chamber includes first and second piston cavities, the first end of the associated piston being in the first piston cavity and the second end of the piston being in the second piston cavity. One or more fluid inlet channels and one or more fluid outlet channels communicate with the second piston cavities in the piston chambers. Axial movement of the pistons effected by rotation of the cam disk or disks pressurizes the fluid in the second cavities of the piston chambers, and forces it into the one or more outlet channels. Check valves in the inlet and outlet channels help maintain the fluid pressure in the piston chambers, and help the pressure to build to a desired level.

The apparatus of the invention may transfer rotational motion of a shaft, to oscillatory motion of pistons or plungers affecting process fluids such as oil, water, gases, and other liquids. In this case, the invention accomplishes the pressurization of fluids so that kinetic energy input is converted to potential energy stored in a fluid.

The apparatus of the invention may also perform the reverse, by transferring the oscillatory motion of pistons or plungers to the rotational motion of a shaft. In this case, the invention uses pressurized fluids to drive the pistons. In other words, potential energy stored in a fluid is converted to kinetic energy.

When used as a pump, the apparatus of this invention can also be made into a pulse jet generator capable of producing high-speed fluid jets as very high frequencies. Further, the apparatus of this invention can be made to function as a fluid-powered high-pressure intensifier capable of transferring energy from one fluid to another. Still further, the apparatus can function as a fluid-powered motor capable of producing very high and smooth torque. The apparatus of this invention has a modular design in which internal piston units are preassembled and can be readily replaced in the field, thus significantly improving their reliability and versatility.

BRIEF DESCRIPTION OF THE DRAWINGS

The different features and preferred embodiments of this invention are apparent from this specification particularly when viewed in light of the drawings, wherein.

DETAILED DESCRIPTION OF THE PRESENTLY PREFERRED EMBODIMENTS

This invention concerns an apparatus that converts the rotation of a shaft to oscillatory or oscillatory and rotary motion of a group of generally parallel, elongated pistons, and vice versa. The oscillatory or oscillatory/rotary motion of these multiple elongated pistons is utilized to perform work, such as pressuring fluid, generating torque, and producing fluid jets. By utilizing unique piston assemblies, the apparatus of this invention can be disabled without shutting off the motor or engine, and its power output can be continuously adjusted.

Applicant's U.S. Pat. No. 5,879,137 teaches a method and apparatus for pressurizing fluids, and the entire disclosure of U.S. Pat. No. 5,879,137 is incorporated by reference into this specification.

Figure 1:
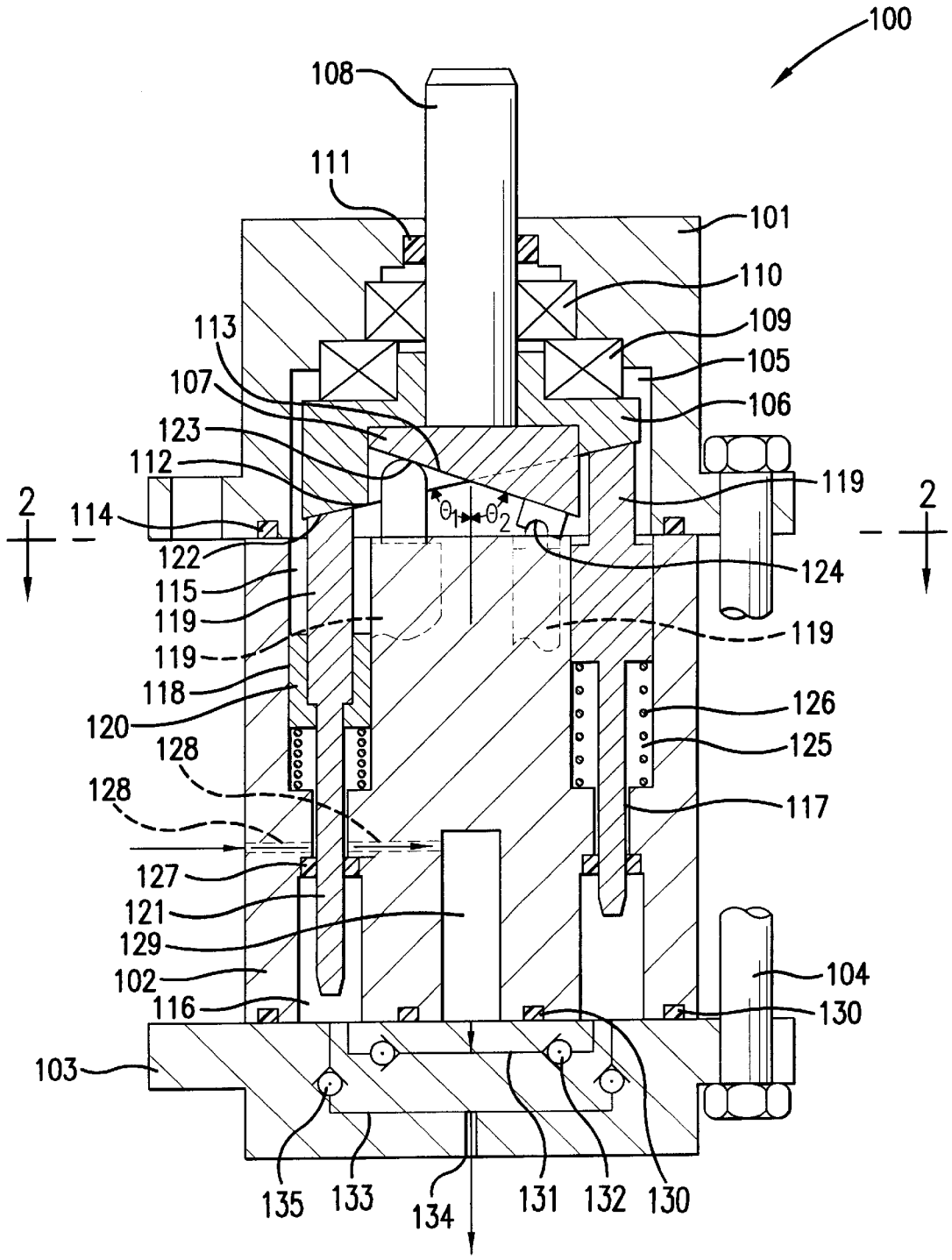
FIG. 1 is a partial cross-sectional and schematic view of a pump, wherein the section is taken along line 1—1, as shown in FIG. 2, according to one preferred embodiment of this invention.

One embodiment of this invention is a rotary, axial-piston pump of high pressure and flow capabilities. Referring to FIG. 1, pump 100 comprises a housing assembly that may have bearing cylinder 101, piston cylinder 102, and outlet cylinder 103 bolted together by tie rods 104 to contain the fluids and internal parts. Bearing cylinder 101 has internal cavity 105 that houses a single or double cam disk assembly that can be made of an outer disk 106 and an inner disk 107. The two cam disks (which can be individual pieces, or a single piece machined from a monolithic block) share a common drive shaft 108 that protrudes outside bearing cylinder 101. The cam disks are supported by suitable bearings that can typically comprise thrust bearing 109 and radial bearing 110. Shaft seal 111 keeps lubricating fluid within cavity 105. The outer cam disk 106 has a slanted face 112 slanting at an angle $\theta_1$ from the plane parallel to the center axis of shaft 108. Inner disk 107 also has a slanted face 113 slanting at an angle $\theta_2$ from the same plane parallel to the center axis of shaft 108. The slanted faces 112 and 113 preferably face each other at a precise angle of 180 degrees. Alternatively, there can be just one cam disk having one slanted face, or more than two cam disks, each having a slanted face of the same slanting angle or different angles. The cam disks are fixed together and are free to rotate inside cavity 105 either by torque applied to shaft 108 or by forces generated internally.

Still referring to FIG. 1, piston cylinder 102 is attached tightly to bearing cylinder 101. Static seal 114 assures no fluid leakage between piston cylinder 102 and bearing cylinder 101. Piston cylinder 102 can be a monolithic cylinder having multiple axially bored cavities, as shown in FIG. 1, or multiple cylinders bolted together. As shown, monolithic piston cylinder 102 has 8 or more axial cylindrical cavities 115 of a given depth connected to axial cylindrical plunger cavities 116 through holes 117. Cavity 115, cavity 116 and hole 117 are axially aligned to accommodate piston assemblies 118 that oscillate, or rotate and oscillate, inside the cavities.

Piston assemblies 118 can each include a monolithic rod having the same or different diameters. Piston assemblies 118 can also be formed from multiple components that may comprise piston rod 119, piston body 120, and plunger 121. Piston rod 119 and plunger 121 can be a single piece or separate components, can be solid or hollow, and can have fluid passages. Piston rod 119 can have a slanted face 122 of the same slanting angle opposing outer disk 106 that it engages, as shown in FIG. 1 by the two outer piston rods 119. Piston rod 119 can also have a round end 123 as shown in FIG. 1 by the left inner piston rod 119, or a ball-joint end equipped with a shoe 124 as shown in FIG. 1 by the right inner piston rod 119, in contact with the slanted face of outer disk 106.

Figure 2:
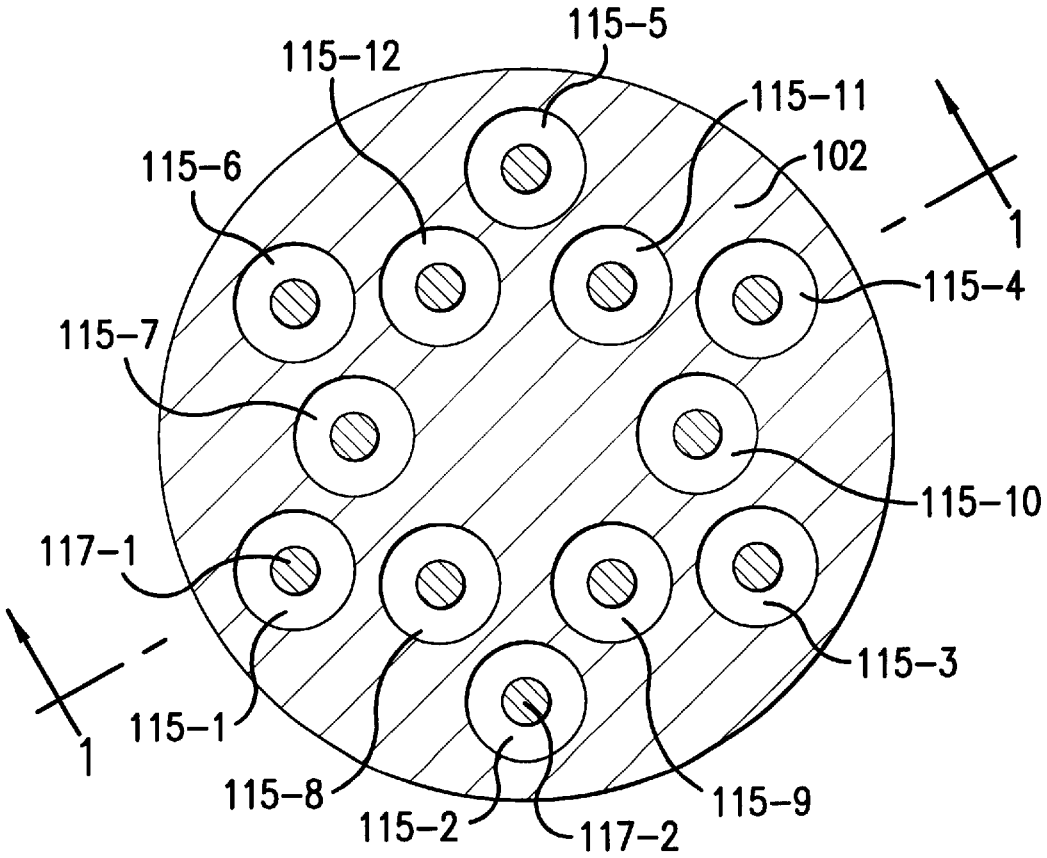
FIG. 2 is a sectional view of the pump shown in FIG. 1, taken along line 2—2 as shown in FIG. 1.
Figure 2A:
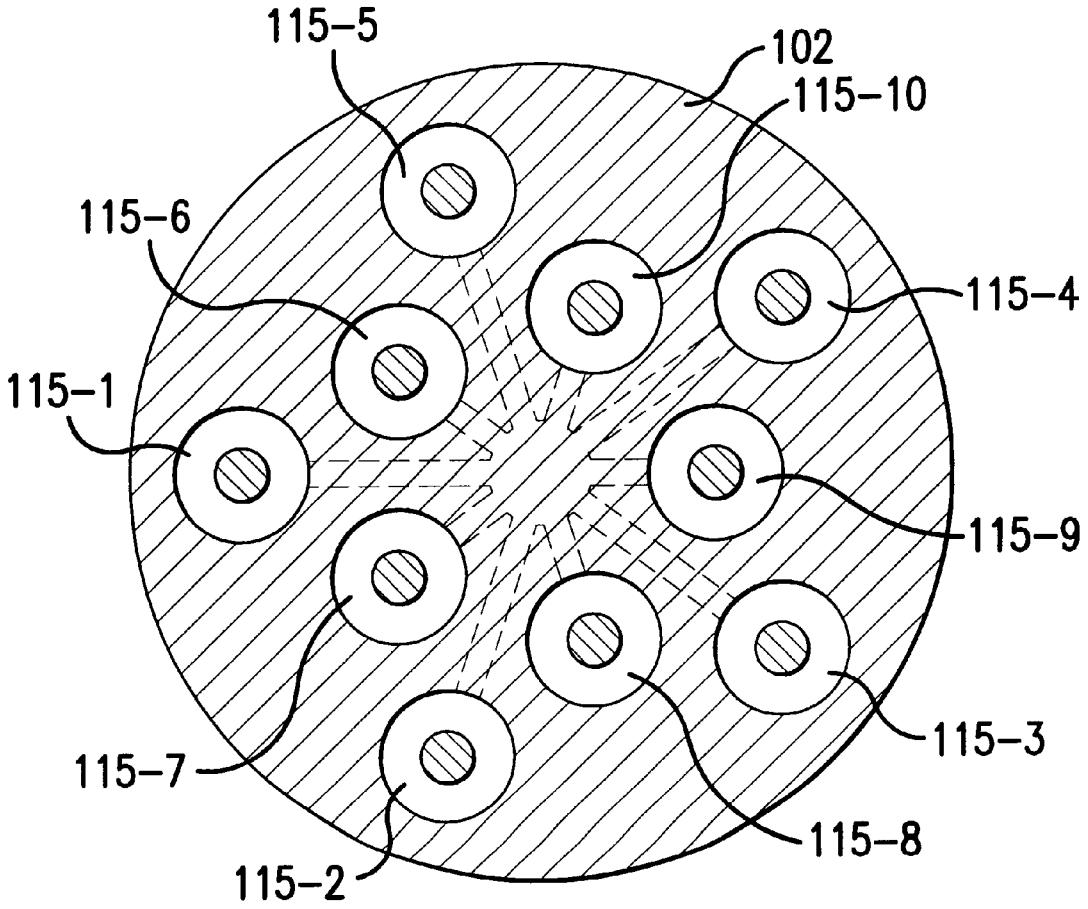
FIG. 2A is a sectional view of a pump similar to the pump shown in FIG. 2, but according to another preferred embodiment of this invention, wherein the pump has ten cylinders.

Cavities 115 are preferably positioned in a circular pattern around the center axis of drive shaft 108. There are at least 3 cavities when there is a one cam disk, or at least 6 cavities, 3 in an outer circle and 3 in an inner circle, when there are two cam disks. The inner and outer circles are at a fixed radius from the center axis and correspond to the diameter of cam disks. A 12-cavity embodiment of this invention is shown in FIG. 2 in which the inner cavities 115-7 through 115-12 and outer cavities 115-1 through 115-6 are spaced at about 60 degrees apart and are staggered for the purpose of better distributing the load on bearings. There could be more or less than 12 cavities and piston assemblies in larger units or in units with slender pistons. For example, the embodiment shown in FIG. 2A comprises 10 cavities, inner cavities 115-6 through 115-10 and outer cavities 115-1 through 115-5, which are preferably spaced about 72 degrees apart.

Figure 3:
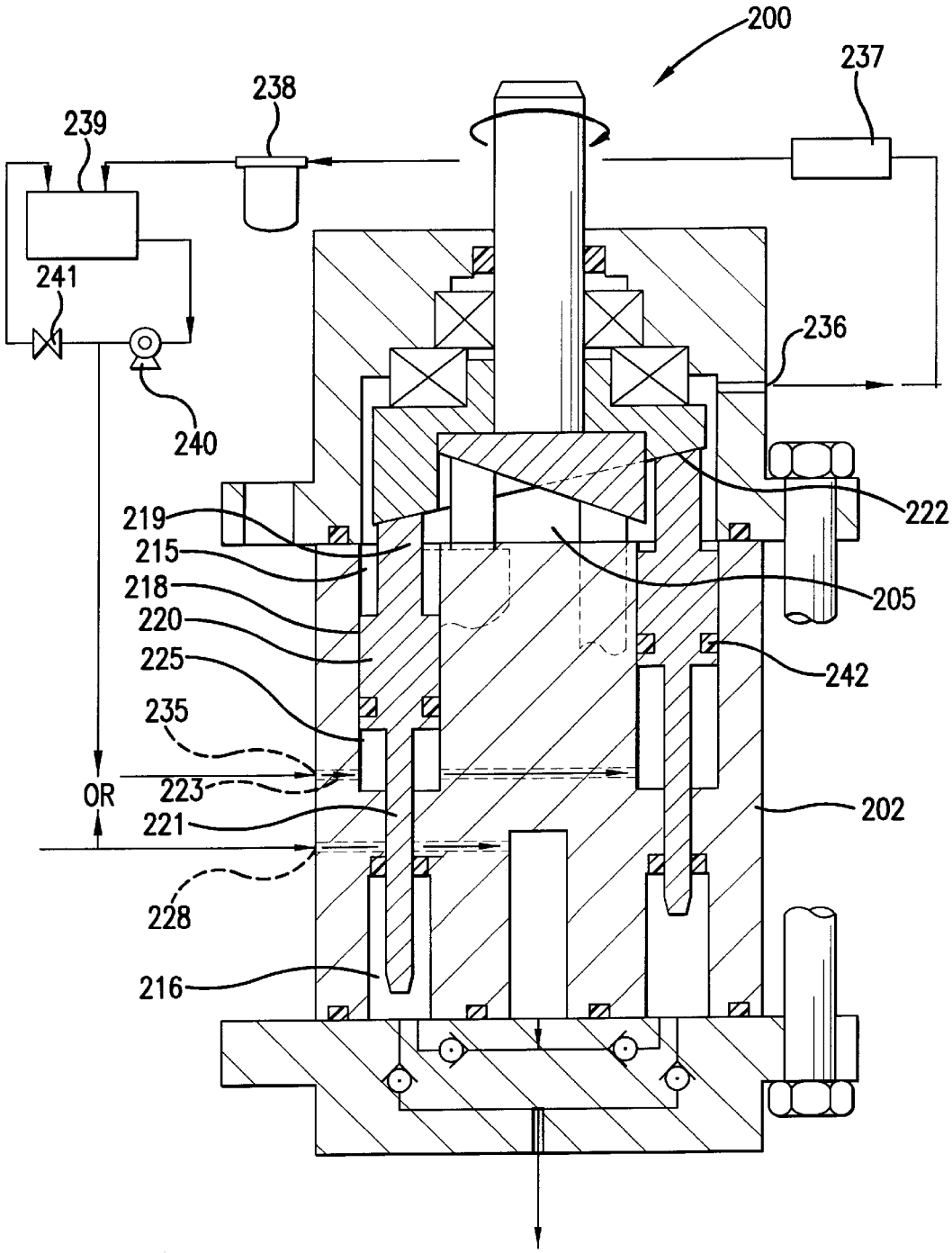
FIG. 3 is a partial cross-sectional and schematic view of a pump, according to another preferred embodiment of this invention.
Figure 6:
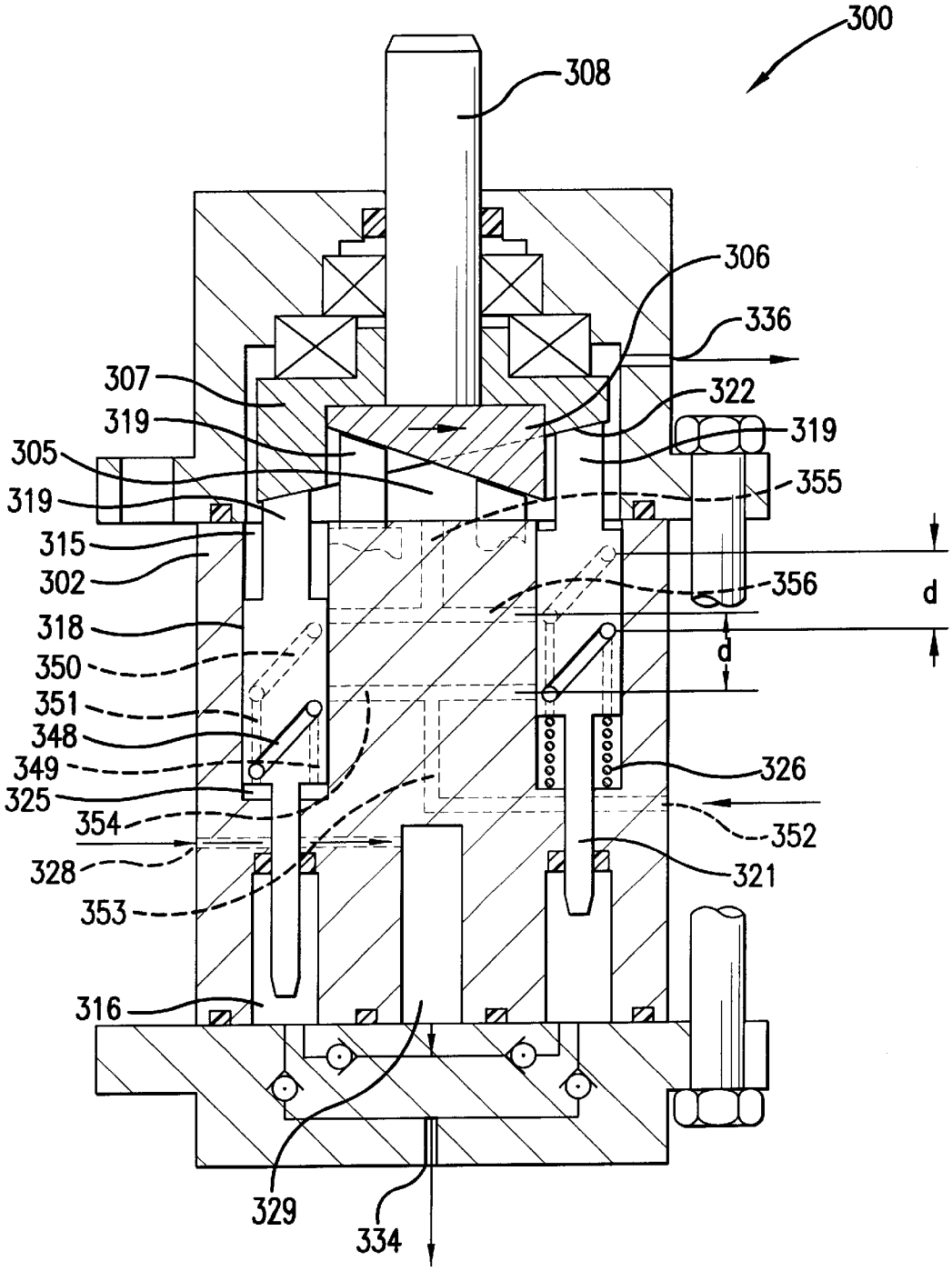
FIG. 6 is a partial cross-sectional and schematic view of a pump, according to another preferred embodiment of this invention.

FIG. 1 is a sectional view taken along line 1—1, as shown in FIG. 2. Although FIG. 1 is a sectional view, only two inner piston rods 119 are shown in dashed lines, for clarification purposes only. Only a portion of each of the two inner piston rods 119 is shown in FIG. 1. FIGS. 3 and 6 similarly show two inner piston rods 219 and 319, respectively, also for clarification purposes only.

Again referring to FIG. 1, piston bodies 120 fit intimately inside cavities 115 and are free to slide and/or rotate. Piston bodies 120 separate inside cavities 115 from lower cocking chambers 125. A bias spring 126 may be located inside cocking chambers 125 to urge piston assemblies 118 and thus piston rods 119 to make contact with slanted face 122. Bias spring 126 may be situated at other locations, such as inside cavity 105, or for example even inside a bore within piston rod 119, or may even be absent altogether. Plungers 121 straddle across cocking chambers 125 and plunger cavities 116 through holes 117. Plunger seals 127 seal off plunger cavities 116. Piston cylinder 102 has inlet 128, shown in FIG. 1 by a dashed line, that connects the ambient to storage cavity 129.

Still referring to FIG. 1, outlet cylinder 103 is tightly attached to piston cylinder 102 by tie rods 104. Static seals 130 assure a fluid-tight interface between piston cylinder 102 and outlet cylinder 103. There are fluid passages 131, shown in schematic form, connecting storage cavity 129 to plunger cavities 116 through inlet check valves 132, and fluid passages 133, shown in schematic form, connecting plunger cavities 116 to outlet 134 through outlet check valves 135. A system fluid, such as water in waterjetting processes, will flow into plunger cavities 116 through inlet 128, storage cavity 129, passages 131, and check valves 132 dependent upon the movement of plungers 121, and will discharge from plunger cavities 116 through outlet check valves 135, passages 133, and outlet 134. The system fluid will flow in a particular plunger cavity 116 when a corresponding plunger 121 is moving up, the so-called suction stroke, and will discharge from the particular plunger cavity 116 when the corresponding plunger 121 is moving down, the so-called power stroke.

Still referring to FIG. 1, when cavity 105 is filled with lubricating oil, a system fluid such as water enters into storage cavity 129 through inlet 128 at a moderate charge pressure. When a rotating force is applied to shaft 108, cam disks 106 and 107 rotate in a clockwise or a counterclockwise direction. By virtue of the slanted face of each of the cam disks, piston rods 119 will slide up and down inside their cavities, and will also rotate if slanted face 122 of piston rod 119 has an identical slanting angle as the corresponding cam disk. Pistons rods 119 with round end 123 or ball-joint-and-shoe end 124 will only oscillate up and down, and will not rotate. In all cases, piston rods 119 will oscillate, or oscillate and rotate in an orderly fashion with the rotation of the corresponding cam disk. As a result, the system fluid entering plunger cavities 116 will be compressed by plunger 121 and discharged from outlet 134 at a much higher pressure.

The maximum pressure that pump 100 can produce is a function of the power applied at the shaft 108 and the number of piston rods 119 and plunger diameters. The maximum discharge rate of pump 100 is a function of the rotating speed of the cam disks, the number of plungers 121, and their displacement. The linear travel of plungers 121 is a function of the slanting angle of the cam disks.

By virtue of the multiple piston rods 119 operating in an orderly sequence, the output pressure of pump 100 can be very smooth, devoid of fluctuations commonly encountered with conventional crankshaft pumps and double-acting intensifiers. The presence of double cam disks better balances the load and results in smooth rotation of the cam disks. Piston rod 119 having slanted face 122 in contact with the cam disk will result in rotary oscillating motion in piston rods 119. This motion will better distribute the wear inside piston cavities 115 and will provide opportunity to incorporate built-in check valve slots. Pump 100 operates using bias springs 126 (or another biasing mechanism) as these springs return piston assemblies 118 to their high positions and to allow plunger cavities 116 to be filled with system fluid. Thus, piston rods 119 contact the cam disks at all times and pump 100 cannot be disabled without stopping the source of the external torque.

The ability to disable a pump internally from outside, without stopping an associated electric motor or other power source, is a very desirable feature in many applications. It is one object of this invention to provide a high-pressure pump that can be disabled from outside by manipulating a working fluid that is used for cocking the piston rods and by using unique piston assemblies that can be engaged or disengaged from the cam disks. With this feature, the high-pressure discharge fluid of a pump can be adjusted or completely shut off. This feature is highly desirable in waterjetting operations, for instance.

Referring to FIG. 3, another embodiment of this invention is a rotary axial piston pump that can be easily disabled. Similar elements have similar reference numerals as in FIG. 1 except that a "2" is used in the first digit instead of a "1". Pump 200 of this invention is very similar to pump 100 except that a moderately pressurized cocking fluid is introduced into cocking chambers 225 via inlet 223 to perform the piston-cocking job previously performed by bias springs 126 in pump 100, and that piston assemblies 118 of the embodiment shown in FIG. 1 now have multiple elements to allow the plungers 221 to be engaged or disengaged from the movement of the cam disks. The cocking fluid must have a moderate pressure capable of forcing up piston assemblies 218 against the cam disks. Piston assemblies 218 can be simply oscillating up and down or oscillating as well as rotating.

The cocking fluid can come from three different sources. It can be supplied from a working fluid power pack equipped with storage tank, filter, heat exchanger, pump, and valves so that the fluid is continuously being circulated in and out of pump 200, as shown in FIG. 3. A lubricating oil would serve as this cocking fluid very well. It enters pump 200 at inlet 235 and discharges at outlet 236. The spent oil can enter heat exchanger 237, through filter 238, and back to storage tank 239.

From storage tank 239, the lubricating oil is drawn into external pump 240 that brings the oil pressure back to a working level, for instance 150 psi. External pump 240 discharges the oil back into pump 200. Bypass valve 241 in the circuit allows this cocking oil to be short-circuited back to tank 239, thus reducing or eliminating the cocking force against piston assemblies 218. When that happens, all piston assemblies 218 will be disengaged or partially disengaged from the cam disks, thus stopping or slowing down the pumping action. Resuming the full flow of cocking fluid into pump 200 will push piston assemblies 218 up against the cam disks and thus resume the pumping action.

Another approach for cocking piston assemblies 218 with fluid is to use the system fluid, which is often precharged to a moderate pressure. By circulating a portion of this system fluid and by controlling the flow with suitable valves, the same result can be achieved in disabling or partially disabling pump 200. However, if the system fluid is not compatible with the lubricating fluid inside cavity 205, piston seals 242 or other seals may be required to isolate the two fluids, and a separate outlet will also be required on piston cylinder 202. With this cocking fluid system, the output of pump 200 can also be adjusted or stopped by manipulating a similar bypass valve.

A third approach for cocking piston assemblies 218 in pump 200 is by using compressed air that is stored inside pump 200 or in a separated storage tank connected to an air compressor. By venting out and making up the air spring inside cocking chambers 225, the pumping action of pump 200 can be disabled and resumed at will. The compressed-air approach has one advantage of being clean and simple but also has the disadvantage of being noisy.

In repeated on-off operations of pump 200, the engagement of piston assemblies 218 must not result in damage to piston rods 219, particularly at slanted face 222. Using round end 123 of piston rod 219 in pump 100, which is not shown in FIG. 3, it may not matter much when it quickly engages the fast rotating cam disk. But with slanted face 222 in pump 200, or shoed ball-joint end 124 in pump 100, fast engagement to a rotating slanted cam disk can cause damage, as piston rods 219 must quickly orient themselves to the cam disk surface. Therefore, it is preferred that piston rods 219 with a slanted face engage the cam disk at all times once the cocking fluid is introduced into the pump. The disengagement should occur below piston rods 219, where two flat (preferably non-slanted) surfaces can engage or disengage in accordance with the availability of fluid force. This invention provides several ways to achieve this objective.

Figure 4:
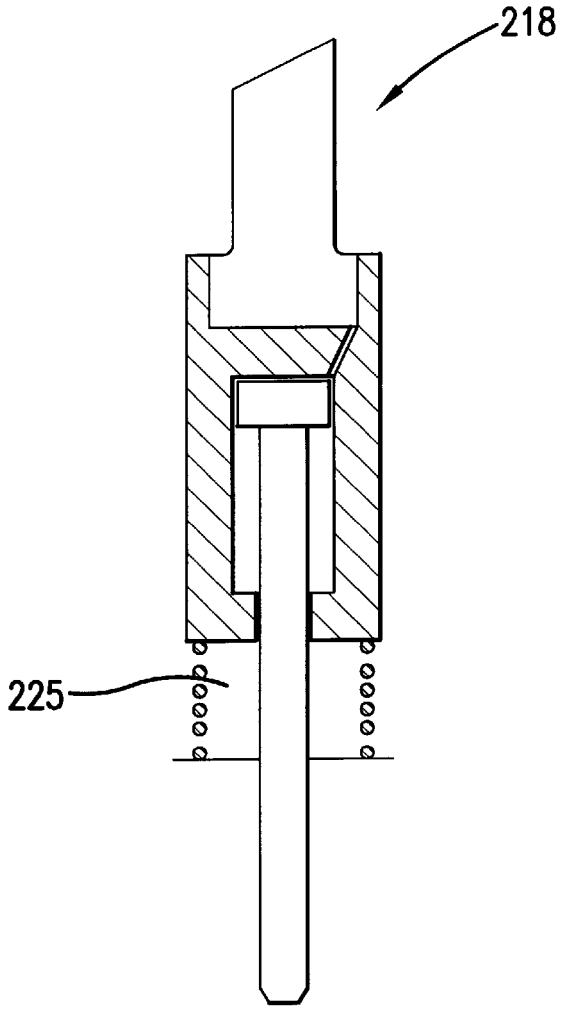
FIG. 4 is a partial cross-sectional view of a piston assembly, with a spring in a compressed state, according to one preferred embodiment of this invention.
Figure 4A:
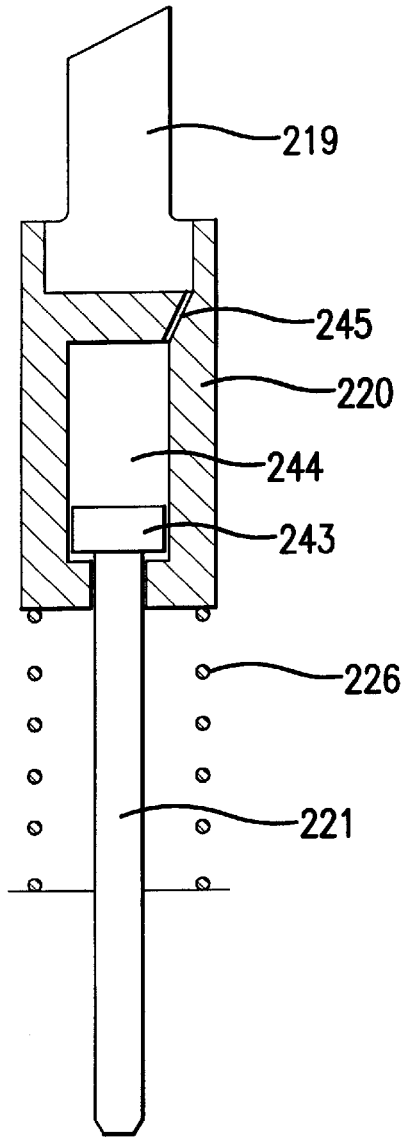
FIG. 4A is a partial cross-sectional view of the piston assembly as shown in FIG. 4, but with the spring in a state which is extended with respect to the state as shown in FIG. 4.

Referring to FIGS. 4 and 4A, one embodiment of pump 200 of this invention has piston assemblies 218 whose plungers 221 have a shoulder 243 situated inside piston body cavity 244. The shoulder is free to slide up and down. Piston body 220 and piston rod 219 are urged by spring 226 to contact the cam disks at all times. Plunger 221, on the other hand, may idle if there is no cocking fluid in chamber 225. Once fluid force is available, shoulder 243 will be pushed up against piston body 220 and plunger 221 will move with the other parts. Plunger shoulder 243 has a flat non-slanted surface, and is capable of contacting the piston body repeatedly with minimal damage. A bleed 245 on piston body 220 can provide fluid cushion for the plunger movement.

Figure 5:
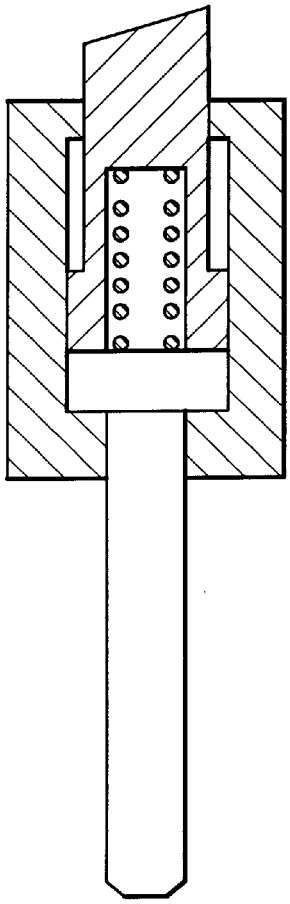
FIG. 5 is a partial cross-sectional view of a piston assembly, according to another preferred embodiment of this invention, with the spring in a compressed state.
Figure 5A:
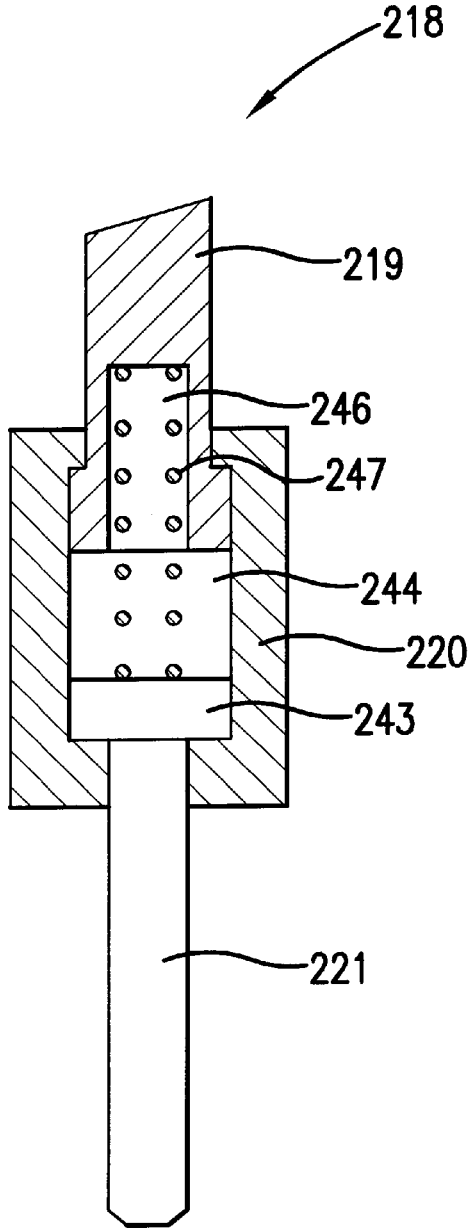
FIG. 5A is a partial cross-sectional view of the plunger assembly as shown in FIG. 5 but with the spring in a state which is extended with respect to the state shown in FIG. 5.

Another embodiment of pump 200 of this invention has piston assemblies 218 which engage and disengage the cam disks in a slightly different way. Referring to FIGS. 5 and 5A, piston rod 219 is situated in and through piston body 220 and is preferably capped so that piston rod 219 can slide and rotate inside piston body cavity 244 but not out of piston body cavity 244. Piston rod 219 has central cavity 246 for accommodating a cocking spring 247 that urges piston rod 219 to engage the cam disk at all times. Piston body 220 and plunger 221 can be one piece or separate units. If separate pieces, plunger 221 has shoulder 243 that is situated inside piston body cavity 244.

Plunger shoulder 243 engages piston rod 219 only when fluid cocking force is available. Piston rod 219, on the other hand engages the cam disk at all times and oscillates or oscillates and rotates within piston body cavity 244 at a speed dictated by the cam disk. Piston body 220 and plunger 221 will move with piston rod 219 only when cocking fluid force is available. If full cocking force is available, the entire piston assembly 218 will move as a single unit.

If only partial fluid cocking force is available, piston rod 219 will engage plunger 221 only partially on its way down, resulting in a partial power stroke for compressing the partially filled system fluid. When there is no cocking fluid force, plunger 221 and piston body 220 will be resting at their lowest position, and pumping action is fully stopped. The pumping action can be fully resumed when fully pressurized cocking fluid is again introduced. Thus, the operation of bypass valve 241, as shown in FIG. 3, is important to operation of pump 200. Bypass valve 241 can be located inside or outside pump 200 and can be manually operated by an operator, or remotely operated by an operator through a mechanical, fluid, electrical, or telecommunicational system.

Bypass valve 241 can also be linked to the discharge fluid of pump 200 such that disturbance to the output fluid pressure or flow will result in appropriate actions in bypass valve 241. Thus, operation of pump 200 can be programmed automatically to a discharge rate of pump 200. For example, partial or full blockage of pump discharge flow may result in programmed reduction or stoppage of the pumping action, automatically.

A further embodiment of this invention is a direct-drive pump that can function as a fluid-powered intensifier of high pressure and flow capabilities. Referring to FIG. 6, intensifier 300 of this invention has a construction very similar to pumps 100 and 200, except that pistons are different and there are internal fluid passages inside piston cylinder 302. Piston assemblies 318 have helical or spiral grooves that function as fluid passages and built-in check valves. Intensifier 300 has inlet check groove 348 and inlet passage 349 on one side and outlet check groove 350 and outlet passage 351 on the other side.

Figure 7:
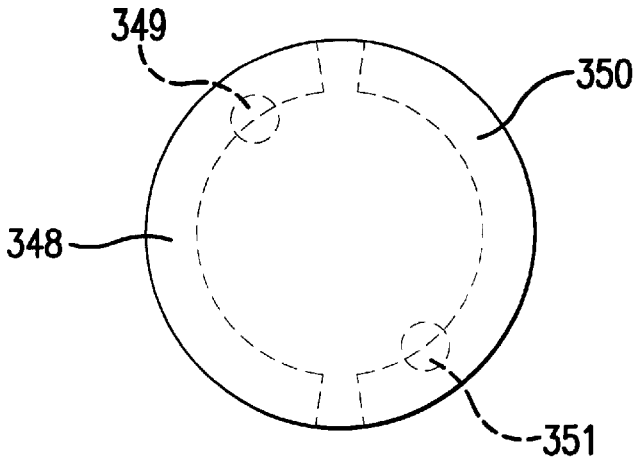
FIG. 7 is a top view of a piston assembly, according to another preferred embodiment of this invention.
Figure 7A:
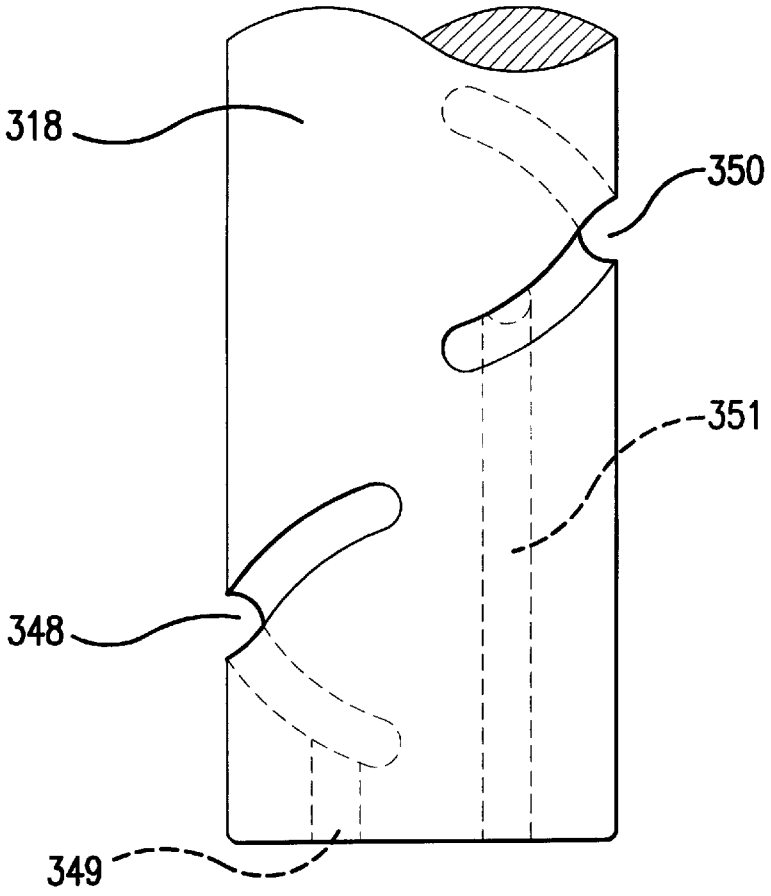
FIG. 7A is a front view of the piston assembly as shown in FIG. 7.

Check grooves 348 and 350 are positioned opposite to each other and at an axial distance d from each other. Each of check grooves 348 and 350 traverse about a circumference of less than 180°, as shown in FIGS. 7 and 7A. Passages 349 and 351 connect check grooves 348 and 350 to cocking chamber 325. Piston cylinder 302 has working fluid inlet 352 leading to central axial cavity 353 and multiple radial passages 354 that terminate at cavities 315 at a point corresponding to check groove 350 during the power stroke. Piston housing 300 also has a central axial cavity 355 that connects bearing cavity 305 to radial multiple passages 356 that terminate at cavities 315 at a point corresponding to check groove 350. The internal fluid passage of a 10-cylinder embodiment of this invention is shown by the dashed lines in FIG. 2A.

Still referring to FIG. 6, during rotation of shaft 308, the pump pistons will rotate and oscillate up and down. Piston assembly 318 on the left represents the lowest position and piston assembly 318 on the right represents the highest position of piston assemblies 318 situated around the outer circle of an 8-piston embodiment of this invention. At the lowest position, cocking chamber 325 is almost empty and inlet check groove 348 is just about to engage inlet passage 354. With a slight rotation in the clockwise direction seen by facing the face of the cam disk, inlet check groove 348 will engage passage 354, thus allowing the pressurized working fluid to enter into cocking chamber 325. Once entered, the pressurized fluid will push piston assembly 318 upward in a rotational way dictated by outer disk 307.

During the upward rotation, inlet check groove 348 never loses its engagement with inlet passage 354 until piston assembly 318 reaches its top position. During the ascent, outlet check groove 350 opposite to inlet check groove 348 is completely blocked out inside cavity 315. When piston assembly 318 reaches the top position, outlet check groove 350 will soon engage outlet passage 356 and will discharge the spent fluid inside cocking chamber 325 into cavity 305 and out of the pump through exit 336. The spent working fluid will be reprocessed through its power pack and returned to intensifier 300 at inlet 352.

During each rotation of the cam disks, all pistons will complete one cycle of their up and down rotary motion. At the same time, the system fluid will enter into plunger cavities 316 and receive energy from plungers 321 and then exit through outlet 334 at a much higher pressure. When cocking chamber 325 receives pressurized working fluid to push up piston assembly 318, plunger cavity 316 receives low-pressure system fluid from storage chamber 329. The up-moving piston assembly 318 transfers the power to outer disk 307, causing it to rotate in the clockwise direction. Other piston assemblies are also moving up, thus adding power to the rotation of the cam disks.

Simultaneously, some piston assemblies are on their way down, thus compressing the system fluid occupying other plunger chambers. Therefore, the cam disk serves the purpose of transferring power from one set of piston assemblies to an opposite set of piston assemblies in an orderly way during the rotation. The pressurized fluid does not directly drive a piston-plunger set in the way found in conventional fluid pressure intensifiers. Nevertheless, intensifier 300 is still a fluid pressure intensifier in a purest sense as energy is freely transferred from one fluid to another fluid, albeit at a slight loss due to the involvement of the piston assemblies and the cam disks.

The cam disk also serves as a valve in conjunction with the built-in check valves on the piston assemblies. FIG. 6 illustrates that intensifier 300 can be operated with the working fluid and the system fluid being the same if cavity 305 is sealed off from the fluid and a separate fluid passage is made on piston cylinder 302 for the working fluid. Further, bias springs 326 may be retained inside cocking chambers 325 to assure that piston assemblies 318 are in correct position at all times regardless if pressurized fluid is present or not.

Intensifier 300 is equipped with an external shaft 308, which rotates when the intensifier is in operation. Shaft 308 can function as a power take-off for driving other devices. Of course, doing that will cause energy to be removed from the task of pressure intensification.

Still referring to FIG. 6, intensifier 300 in reality is also a direct-drive pump if a power source applies torque to shaft 308 and the pressure of the working fluid is drastically reduced to function as a piston cocking fluid similar to that of pump 200. With cocking fluid flowing through the check grooves of each piston assembly and ending up in cavity 305 will help the lubrication in a way no different from that of pump 200. Therefore, intensifier 300 is truly both a fluid pressure intensifier and a direct-drive pump that can be connected directly to a prime mover.

Furthermore, intensifier 300 can be a fluid-powered motor if the system fluid is shut off and the plungers are allowed to idle. The energy contained in the pressured working fluid will be used to rotate shaft 308. The shaft power produced at shaft 308 will be very smooth due to the presence of many piston assemblies 318.

A 10-piston motor of this invention is analogous to a 10-cylinder engine. This is made possible by the unique check groove arrangement on piston assemblies 318, as shown in FIGS. 7 and 7A. It is evident that the position, width, depth, and general characteristics of the check grooves are of vital importance to the performance of intensifier/pump/motor 300. On the other hand, piston assemblies 318 of the inner circle and outer circle of a 10-piston pump 300 of this invention may differ only on the slant angle at slanted face 322 of piston rods 319. They may be identical in all other respects.

Figure 8:
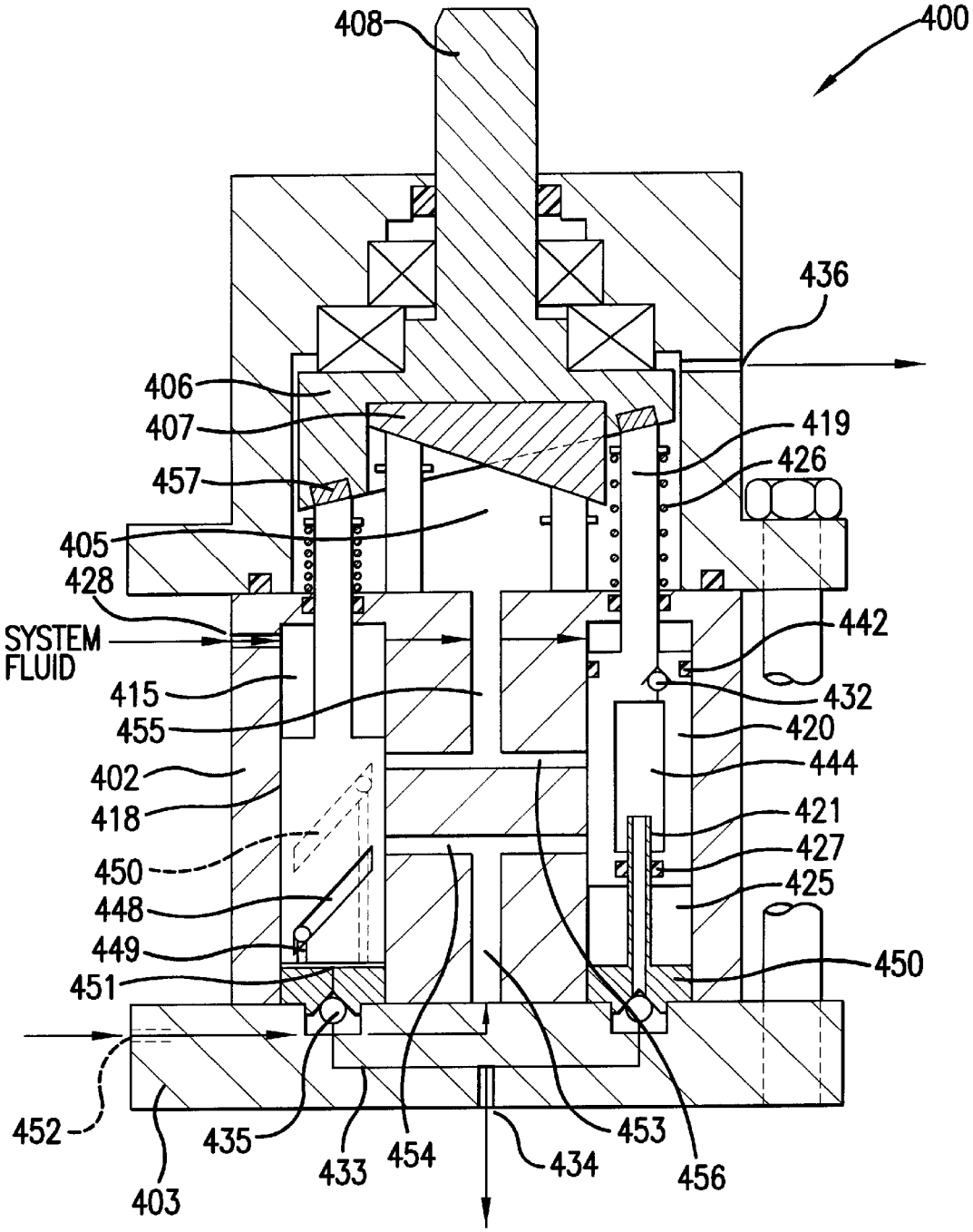
FIG. 8 is a partial cross-sectional and schematic view of a pump, according to another preferred embodiment of this invention.

Referring to FIG. 8, a further embodiment of this invention is a device that can function as a direct-drive pump, a fluid pressure intensifier, and a fluid powered motor. Comparing FIG. 8 to FIG. 6, identical elements have similar reference numerals except that the first digit "3" has been replaced with "4". Pump 400 of this invention is very similar to pump 300 except the piston assemblies 418 are different. In pump 400, piston bodies 420 serve as high-pressure cylinders and their internal cavity 444 accommodates stationary hollow plunger 421. Piston rod 419 and piston body 420 can be a single piece or separate components. Piston body 420 is equipped with inlet check valve 432, shown in schematic form in FIG. 8, allowing fluid to enter into internal cavity 444 from cavity 415, which is isolated from cavity 405 and is filled with the system fluid.

Piston bodies 420 have helical or spiral grooves, and axial fluid passages to serve as inlet and outlet check valves, as in the case of pump 300. Grooves 448 and passages 449 serve as inlet check valves while grooves 450 and passages 451 serve as outlet check valves. Piston cylinder 402 has internal fluid passages 453, 454, 455 and 456 similar to that of pump 300 to connect all piston cavities to the inlet and outlet of working fluid. Hollow plungers 421 are anchored in plugs 450 that serve as an outlet check valve body for the system fluid and are engaged to outlet cylinder 403. Fluid passages 433, shown in schematic form in FIG. 8, in outlet cylinder 403 connect all outlet check valves 435 to a common outlet 434.

Bias springs 426 can be mounted inside cocking chamber 425 or inside cavity 405 above piston cylinder 402, as shown in FIG. 8. Bias springs 426 can also be mounted inside a bore within piston rods 419, as shown in FIG. 5, to assure intimate contact between piston rods 419 and the cam disks. Thrust bearings 457 or thrust plates can be placed between the cam disks and piston rods 419 to reduce friction.

Still referring to FIG. 8, when torque is applied to shaft 408, piston assemblies 418 rotate and oscillate up and down, thus compressing the system fluid inside piston body cavities 444. The system fluid flows out of the hollow plungers, through outlet check valves 435, and out of pump 400 at outlet 434. By virtue of piston bodies 420 serving as pressure vessels, piston cylinder 402 is shortened and is simplified as it is no longer exposed to the system fluid at very high pressures. Thus, pump 400 can be very compact and yet maintains its high flow capability.

Pump 400 can also be a fluid pressure intensifier when high-pressure working fluid is introduced to compress the system fluid. Pump 400 can also be a fluid powered motor as useful work can be derived from shaft 408 when a pressurized working fluid is introduced into pump 400 while the system fluid is shut off or is allowed to behave as a lubricating fluid.

Figure 9:
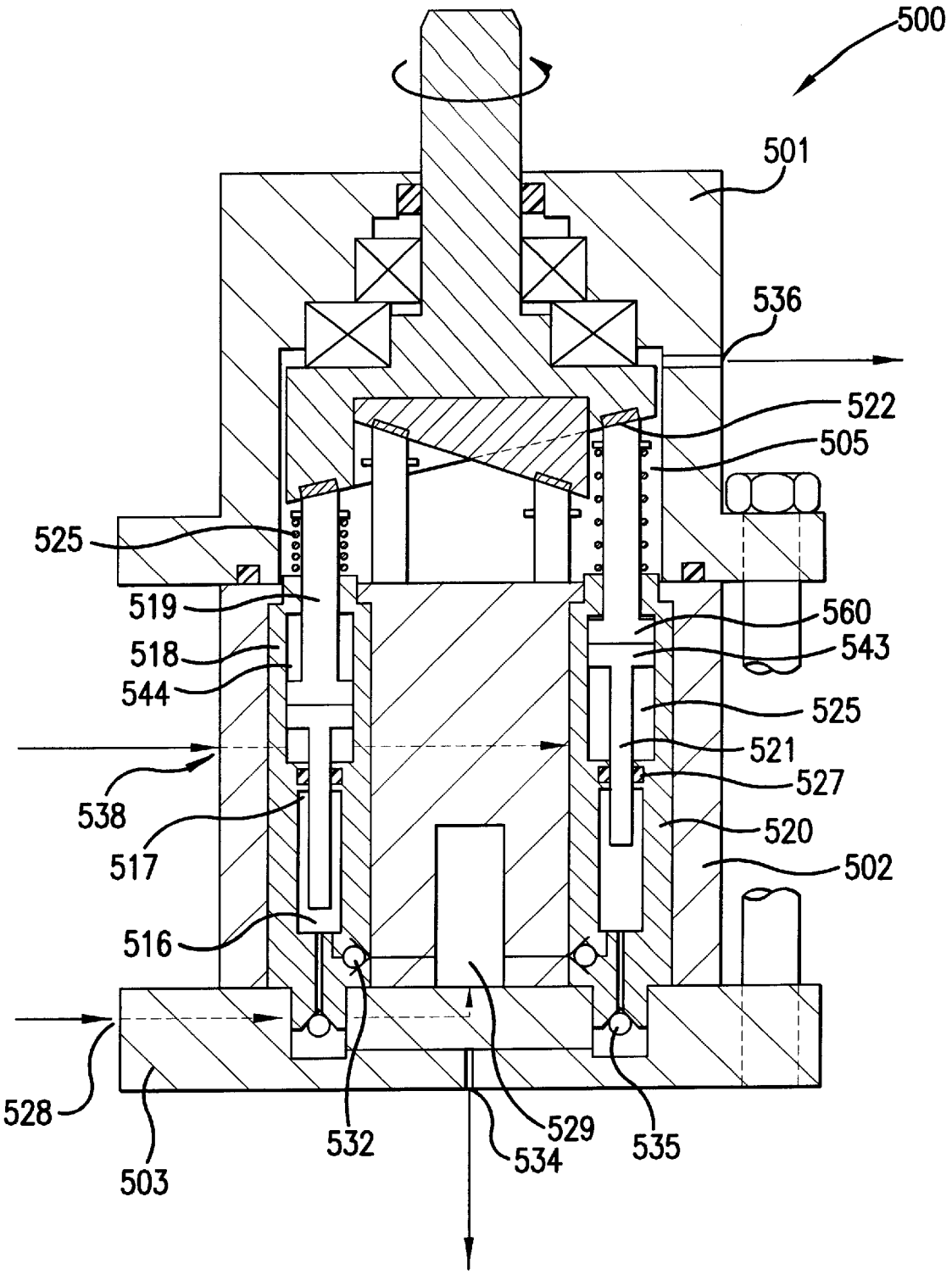
FIG. 9 is a partial cross-sectional and schematic view of a pump, according to another preferred embodiment of this invention.

A still further embodiment of this invention is a high-pressure pump having a modular design where each of the multiple pumping elements is preassembled, independent of each other, and can be individually removed or installed in the pump. Pump 500, as shown in FIG. 9, is very similar in construction to pump 200 except that piston assemblies 518 are preassembled in the form of a modular pumping unit complete with all the essential elements for compressing a system fluid. Piston assemblies 518 are in the form of a cylindrical unit including piston cylinder 520 comprising two or more cylindrical elements with central cavities to accommodate piston rod 519 and plunger 521. Piston cylinder 520 has upper piston chamber 544 and lower high-pressure chamber 516 connected by passage 517.

Piston rod 519 has shoulder 560 and plunger 521 has shoulder 543. Both shoulders fit inside chamber 544 and are free to rotate or oscillate. Shoulder 543 divides chamber 544 into an upper chamber and lower cocking chamber 525 that has a fluid passage that leads to working fluid inlet 538. Piston rod 519 straddles across piston cylinder 520 with slanted face 522 extending outside piston assembly 518. Cocking spring 525 around piston rod 519 urges piston rod 519 to engage the cam disk. This cocking spring 525 can be located outside piston cylinder 520, as shown in FIG. 9, or inside piston cylinder 520.

Each piston assembly 518 is equipped with an inlet check valve 532 in fluid communication with system fluid chamber 529 when piston assembly 518 is installed. Chamber 529 is connected to system fluid inlet 528. Each piston assembly 518 may or may not comprise an outlet check valve 535, which is preferably to be a part of outlet cylinder 503.

Still referring to FIG. 9, pump 500 has cylinder 501 containing the cam disks and support bearings. Piston cylinder 502 is preferably a cylindrical unit having multiple axial bores to accommodate the multiple piston assemblies 518 and to provide the fluid passages. The working fluid serves the purpose of cocking the plungers upward to engage piston rods 519. Releasing the pressure of this cocking fluid disables the plunger and stops the pumping action. If the cocking fluid is a lubricating oil, it is allowed to flow into cavity 505 and discharge from pump 500 at outlet 536. Otherwise, seals are needed to isolate the working fluid from cavity 505.

Pump 500 is ideally suited for high-pressure, high-flow operations in which reliability is most important. By isolating all the pumping elements, malfunction of one element is not likely to affect the others. All pumping elements are self-contained and preassembled. Thus, when failure occurs in the pumping elements, they can be readily replaced by removing the outlet cylinder 503 to expose all elements.

This modular approach of building high-speed pumps is particularly well suited for larger pumps, as significant reduction in weight can be achieved. It is also very well suited for high-pressure applications, since the high-pressure cylinders are relatively small and can be made with great care in terms of material selection, treatment and construction. Since the piston assemblies are replaceable, different sets of piston assemblies can be made available for use in a single pump to vary the pressure-flow output. Thus, one pump can serve different purposes. It is thus evident that pump 500 can be of very significant value in waterjetting applications.

Figure 10:
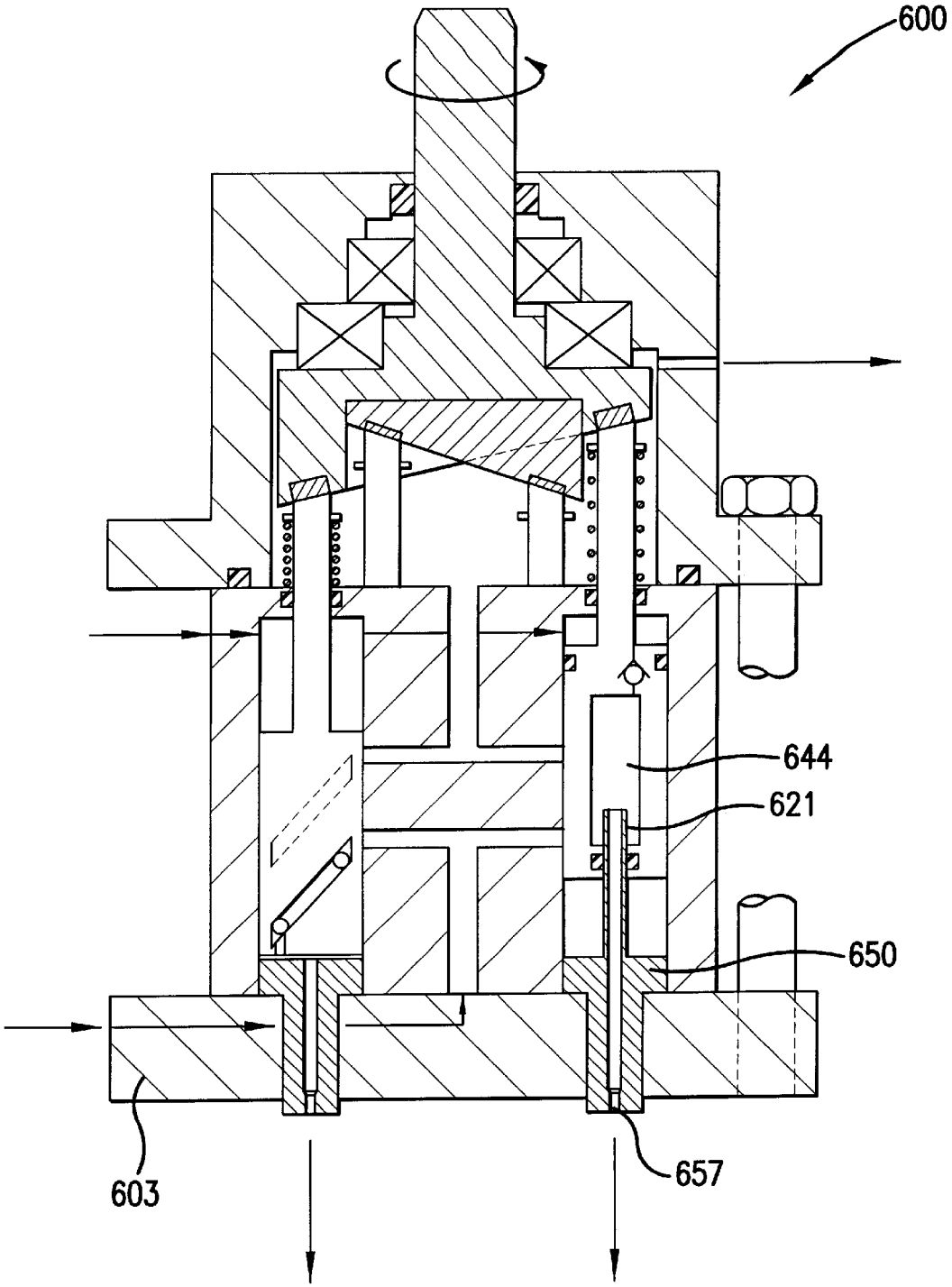
FIG. 10 is a partial cross-sectional and schematic view of a pulsejet generator, according to one preferred embodiment of this invention.

A still further embodiment of this invention is a pulsed fluid jet generator that is capable of producing high-speed fluid jet pulses at high frequencies. Referring to FIG. 10, pulsejet generator 600 of this invention can be based on a pump 100, 200, 300, 400 or 500 of this invention, modified by removing all outlet check valves for the system fluid and by installing multiple outlet nozzles. Pulsejet generator 600 shown in FIG. 10 is basically pump 400 having plugs 650 integrated with hollow plungers 621 to form a nozzle.

Orifices 657 positioned at the external end of plugs 650 allow high-speed fluid jets to issue into the ambient. Outlet cylinder 603 has no outlet fluid passages. The system fluid still enters into each high-pressure chamber 644 to receive energy and to be ejected out of each orifice 657.

In a 10-plunger pump of this invention, each revolution of the cam disk assembly will produce 10 jet pulses. If the pump is operating at a standard motor speed of 1800 rpm, there will be 300 jet pulses issued from generator 600 every second. In waterjet cleaning operations, high-pressure pulsed waterjets produced at such frequency and density can be very useful in removing paint and rust.

As indicated previously, generator 600 can be a fluid pressure intensifier powered by hydraulic fluid. Thus, generator 600 can be operated in confined space requiring only a set of hydraulic hoses and a water supply hose to function. There is no need for a high-pressure water hose or a separate nozzle system. The amount of fluid ejected from each nozzle per pulse is a function of the displacement of each piston. The velocity of the fluid pulses is a function of the power input into the pump, the pump design, and the orifice openings. Pulsed fluid jets of very high velocity can be generated by this device.

Examining FIGS. 6 and 9 will show that the modular piston assembly design of this invention can be applied to construct a fluid pressure intensifier or a fluid powered motor. Each piston assembly is a fluid powered thrust generator having a piston rod that has an integral plunger on its opposite end. When assembled together with the cam disks, when one set of piston assemblies push against the cam disk, the opposite set of piston assemblies are pushed down by the cam disk to compress the system fluid.

This modular intensifier will have the same benefit in improved reliability as each piston assembly is preassembled and can be readily replaced. One disabled piston assembly will not disable an entire unit. This is an improvement over conventional double-acting two-piston intensifiers.

EXAMPLE

A direct-drive pump according to the design presented in FIG. 9 was constructed and successfully tested. The pump comprised a bearing cylinder, a piston cylinder, multiple piston assemblies, and an outlet cylinder bolted together with six tie rods. The bearing cylinder was 6 inches in diameter including a compound cam disk assembly, a thrust bearing set, and a radial bearing set. A 1.250-inch-diameter shaft extended outside the bearing housing, which was machined out of a steel round. The cam disks were machined out of a solid hardened steel round and had slanted faces. The outer cam disk face was slanted at 12 degrees while the inner cam disk face was slanted at 21 degrees. The outer cam disk was 3.6 inches in diameter while the inner disk was 1.250 inches in diameter. The cam disk could be easily rotated by applying torque at the outside shaft. Roller thrust bearings were placed on the face of both cam disks.

The piston cylinders of this pump were made of hardened stainless steel and were 4.5 inches in diameter and 2.3 inches in depth. There were 10 cavities of 0.814 inches in diameter arranged in a pattern shown in FIG. 2A to accommodate the cylindrical piston assemblies. These piston assemblies included a piston cylinder assembled out of 3 elements, including two end caps and a center cylinder, all made of hardened stainless steel. The piston cylinders were 0.813 inches in diameter and about 4.3 inches in length. The piston rods were 0.5 inches in diameter and about 1.6 inches long having a hollow chamber to accommodate a compression spring. The five piston rods for the inner piston assemblies had 21-degree slanted faces while the five pistons for the outer piston assemblies have 12-degree slanted faces.

The plungers were 0.188 inches in diameter and about 2.5 inches in length. Both the piston rods and plungers were made of hardened stainless steel. The piston cylinders had an upper cocking chamber of about 0.500 inches in diameter and a lower high-pressure chamber of 0.312 inches in diameter. The piston cylinder had a fluid passage allowing lubricating oil to enter into the cocking chamber and another fluid passage allowing system fluid to enter into the high-pressure chamber through a conventional disk-seal-spring type of check valve.

There was an outlet from the high-pressure chamber, which fit a cavity in the outlet cylinder to form a fluid-tight seal. A disk-type outlet check valve was situated in the outlet cavity of the outlet cylinder. When assembled, the lower space between the piston assemblies was filled with the system fluid that could readily enter into the high-pressure chambers during the suction stroke.

The 10-piston pump was connected to a small hydraulic power pack capable of supplying low-flow-rate hydraulic oil at pressures up to 1500 psi. During testing, the output pressure of this power pack was set at about 100 psi. At this pressure, the hydraulic oil provided a cocking force of about 17 lbs in each piston assembly. The test pump was connected to a 7.5-hp electric motor rotating at a normal speed of 1750 rpm through a belt-and-pulley arrangement. The hydraulic oil was allowed to flow through each piston assembly into the bearing cavity, and out of the bearing housing, thus providing thorough lubrication of the piston assemblies. A dump valve was installed in the oil circuit, allowing the cocking oil pressure inside the pump to be relieved instantly.

A high-pressure tube and a nozzle were connected to the outlet of the test pump. Tap water was introduced into the pump at 70 psig pressure. At 1750 rpm, the pump had a theoretical flow rate of about 1.3 gpm as the stroke of each plunger was about 0.6 inches. Actual measurement of the pump discharge showed about 1.1 gpm. After placing a 0.020-inch-diameter sapphire orifice in the outlet nozzle, the pump produced a waterjet at a registered pressure of about 12,000 psi. The pressure was increased to about 30,000 psi when a 0.010-inch-diameter orifice was placed into the nozzle.

The output pressure of this pump was very smooth, showing only minute fluctuations. The benefit of having 10 pistons was clearly observed. The pump ran smoothly and devoid of vibrations commonly observed with conventional crankshaft pumps.

When the oil dump valve was activated, the cocking oil was returned to a tank of the hydraulic power pack and the pump quickly lost its output pressure. When the oil dump valve was again closed, a tapping sound from the pump was heard and the pump resumed pumping instantly. Repeated operation of the oil dump valve showed repeated on-off operations of the pump. Therefore, if this oil dump valve was operated remotely by means of an electrical or compressed-air circuit, a waterjet applied away from this pump could be readily controlled without dumping the high-pressure water or shutting off the engine or motor.

While the embodiments of the invention described herein are presently preferred, various modifications and improvements can be made without departing from the spirit and scope of the invention. The scope of the invention is indicated in the appended claims, and all changes that fall within the meaning and range of equivalents are intended to be embraced therein.

I claim:

1. An apparatus for transferring and applying pressure to fluids, comprising:

a housing having an internal housing cavity containing a working fluid;

a drive shaft communicating with the internal housing cavity;

a first rotatable cam disk having a first end communicating with the drive shaft and a second end, the second end having a surface which is slanted relative to a plane perpendicular to the drive shaft;

a plurality of pistons in the housing cavity, each piston having a first end communicating with the slanted surface of the first cam disk and a second end away from the first cam disk;

a plurality of piston chambers in the internal housing cavity, each piston chamber housing a piston and having first and second piston cavities, the first end of the piston being in the first piston cavity and the second end of the piston being in the second piston cavity, the second piston cavity containing a system fluid;

one or more piston seals positioned on each piston separating the working fluid from the system fluid;

one or more fluid supply channels communicating with the piston chambers; and one or more fluid outlet channels communicating with the piston chambers;

wherein axial movement of the pistons effected by rotation of the cam disk pressurizes system fluid in the second piston cavities of the piston chamber, and forces the system fluid into the one or more fluid outlet channels.

2. The apparatus of claim 1, wherein the first end of each piston comprises a slanted surface communicating with the slanted surface of the cam during rotation of the cam.

3. The apparatus of claim 1, wherein the first end of each piston comprises a round surface communicating with the slanted surface of the first cam disk during rotation of the first cam disk.

4. The apparatus of claim 1, further comprising a second rotatable cam disk having a first end communicating with the drive shaft and a second end, the second end having a surface which is slanted relative to a plane perpendicular to the drive shaft, and a plurality of pistons communicating with the slanted surface of the second cam disk.

5. The apparatus of claim 4, wherein the slanted surface on the second cam disk and the slanted surface on the first cam disk have angles which oppose each other.

6. The apparatus of claim 1, wherein the one or more fluid supply channels comprise at least one check valve.

7. The apparatus of claim 1, wherein the one or more outlet channels comprise at least one check valve.

8. The apparatus of claim 1, comprising at least three of the pistons arranged in a first circle, and communicating with the first rotatable cam disk.

9. The apparatus of claim 4, comprising at least three of the pistons arranged in a first circle, communicating with the first rotatable cam disk, and at least three of the pistons arranged in a second circle, communicating with the second rotatable cam disk.

10. The apparatus of claim 1, wherein the first piston cavity of each piston chamber comprises a biasing mechanism urging the piston toward the cam disk.

11. The apparatus of claim 10, wherein the biasing mechanism comprises a spring.

12. The apparatus of claim 10, wherein the biasing mechanism comprises pressurized fluid.

13. The apparatus of claim 1, further comprising a disengagement mechanism for disengaging the piston from the cam disk.

14. The apparatus of claim 13, wherein the disengagement mechanism comprises a body cavity in each piston, and a movable shoulder inside the cavity.

15. The apparatus of claim 13, wherein the disengagement mechanism comprises a body chamber in each piston, a piston cap inside the body chamber and movable therein, and a piston rod attached to the piston cap, and a plunger having one end in the body chamber.

16. The apparatus of claim 1, further comprising a bypass valve associated with the fluid supply channels.

17. A fluid-powered intensifier, comprising:

a housing having an internal housing cavity containing a working fluid;

a drive shaft having one end in the housing cavity;

a first rotatable cam disk having a first end communicating with the drive shaft and a second end, the second end having a slanted surface;

a plurality of pistons in the housing cavity, each piston having a first end communicating with the slanted surface of the first cam disk and a second end away from the first cam disk;

a plurality of piston chambers having walls surrounding the pistons, the plurality of piston chambers containing system fluid;

one or more piston seals positioned on each piston separating the working fluid from the system fluid;

grooves within the pistons defining piston fluid passages between the pistons and piston chamber walls; and first inlet and first outlet fluid passages in the intensifier communicating with the grooves in the pistons.

18. The intensifier of claim 17, wherein the grooves in the pistons have a helical configuration.

19. The intensifier of claim 17, further comprising:

one or more second fluid inlet channels communicating with the piston chambers; and one or more second fluid outlet channels communicating with the piston chambers.

20. The intensifier of claim 17, wherein each piston chamber comprises first and second piston cavities, the first end of each piston being in the first piston cavity, the second end of each piston being in the second piston cavity.

21. The intensifier of claim 17, wherein the first end of each piston comprises a slanted surface communicating with the slanted surface of the first cam disk during rotation of the first cam disk.

22. The intensifier of claim 17, further comprising a second rotatable cam disk having a first end communicating with the drive shaft and a second end, the second end having a surface which is slanted relative to a plane perpendicular to the drive shaft.

23. The intensifier of claim 22, wherein the slanted surfaces on the first and second cam disks have angles which oppose each other.

24. A direct-drive pump, comprising:

a housing having an internal housing cavity containing a working fluid;

a drive shaft having a first end in the housing cavity and a second end;

a power source for applying torque to the drive shaft;

a first rotatable cam disk having a first end communicating with the first end of the drive shaft and a second end having a slanted surface;

a plurality of pistons in the housing cavity, each having a flat end communicating with the slanted surface of the first cam disk and a second end away from the first cam disk;

a plurality of piston chambers containing a system fluid separate from the working fluid and having walls surrounding the pistons;

grooves within the pistons defining piston fluid passages between the pistons and piston chamber walls; and first inlet and first outlet fluid passages in the intensifier communicating with the grooves in the pistons.

25. The direct-drive pump of claim 24, further comprising a second rotatable cam disk having a first end communicating with the first end of the drive shaft and a second end having a slanted surface.

26. The direct-drive pump of claim 23, further comprising a second plurality of pistons in the housing cavity, each having a first end communicating with the slanted surface of the second cam disk and a second end away from the second cam disk.

27. The direct-drive pump of claim 25, wherein the slanted surfaces of the first and second rotatable cam disks have angles which oppose each other.

* * * * *